US012297066B2

(12) United States Patent
Roque

(10) Patent No.: US 12,297,066 B2
(45) Date of Patent: May 13, 2025

(54) ERGONOMIC TAPE HOLDER AND METHOD OF USE THEREOF

(71) Applicant: David Roque, San Diego, CA (US)

(72) Inventor: David Roque, San Diego, CA (US)

( * ) Notice: Subject to any disclaimer, the term of this patent is extended or adjusted under 35 U.S.C. 154(b) by 0 days.

(21) Appl. No.: 17/718,244

(22) Filed: Apr. 11, 2022

(65) Prior Publication Data

US 2022/0348434 A1 Nov. 3, 2022

Related U.S. Application Data

(60) Provisional application No. 63/181,916, filed on Apr. 29, 2021.

(51) Int. Cl.
*B65H 49/20* (2006.01)
*B65H 75/12* (2006.01)

(52) U.S. Cl.
CPC ..... *B65H 49/205* (2013.01); *B65H 75/12* (2013.01); *B65H 2402/411* (2013.01); *B65H 2701/377* (2013.01)

(58) Field of Classification Search
None
See application file for complete search history.

(56) References Cited

U.S. PATENT DOCUMENTS 1,213,102 A * 1/1917 Hill ..... A45F 5/00 33/760
1,354,434 A * 9/1920 Fassoulis ..... A47F 13/045 242/156
3,149,764 A * 9/1964 Waltz ..... B65H 35/0026 225/57
3,705,697 A * 12/1972 Chagnon ..... B63C 11/26 242/387
3,921,936 A * 11/1975 Suter ..... B65H 35/0026 242/588.1
3,980,245 A * 9/1976 Delehoy ..... B65H 35/0026 242/588.1
4,880,152 A * 11/1989 Trankle ..... B65H 35/0026 224/267
4,928,864 A * 5/1990 Walker ..... B65H 35/0026 225/66
5,115,648 A * 5/1992 Salvucci ..... A61F 5/50 242/405
5,215,236 A * 6/1993 Waddell ..... B65H 35/0026 224/267
D347,589 S * 6/1994 LaBate ..... D10/74
5,961,066 A * 10/1999 Hambleton ..... B65H 35/0026 224/267
6,085,955 A 7/2000 Hicks
9,873,582 B2 * 1/2018 Stenavich ..... B65H 75/446
10,435,268 B2 10/2019 Briggs
2002/0185512 A1 * 12/2002 Shah ..... B65H 35/0026 225/56
2004/0060955 A1 * 4/2004 Cheng ..... B65H 35/0026 225/6
2007/0051474 A1 * 3/2007 Grenier ..... B65H 35/0026 156/577

(Continued)

*Primary Examiner* — William A. Rivera

(57) ABSTRACT

The present disclosure relates to an ergonomic tape holder onto which a roll of tape is mounted and secured. In particular, the ergonomic tape holder is a single-piece and unitary constructed apparatus having vertical towers disposed on a fixed based which prevents the roll of tape from shifting, rolling, or moving about the base.

19 Claims, 13 Drawing Sheets

(56) References Cited

U.S. PATENT DOCUMENTS

| | | | | |
|---|---|---|---|---|
| 2007/0158030 | A1* | 7/2007 | Kyriacou ..... | B65H 35/0026 156/577 |
| 2009/0230164 | A1* | 9/2009 | Freeman ..... | B65H 35/0073 225/78 |
| 2021/0403271 | A1 | 12/2021 | Theofilos | |

* cited by examiner

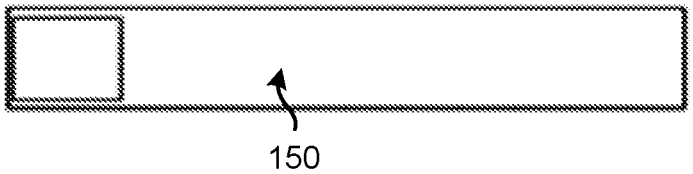
FIG. 4A
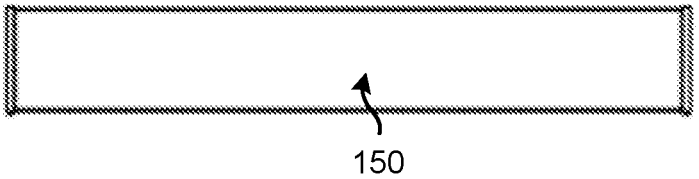
FIG. 4B
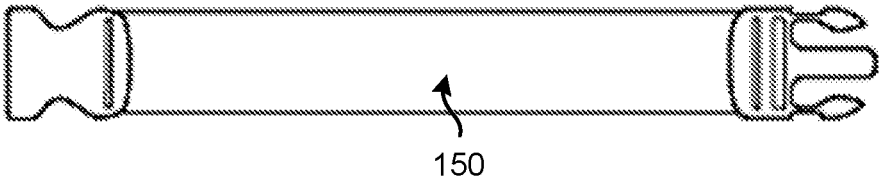
FIG. 4C
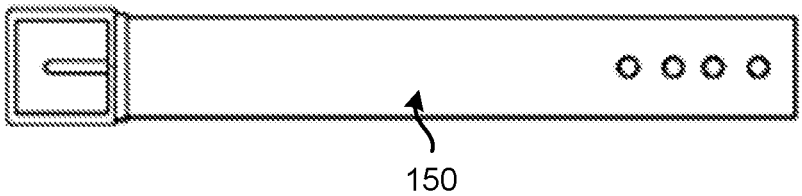
FIG. 4D
FIG. 4

300

Positioning the ergonomic tape holder 100 over a wrist or forearm of a user so that the two vertical towers (103A, 103B) project above a top portion of a hand of the user; 301

Securing the strap 150 of the ergonomic tape holder 100 to their wrist or forearm via hook-and-loop fasters; 302

While holding the roll of tape 200 with their other hand, positioning the center core of the roll of tape 200 so that is centered between the vertical towers (103A, 103B); 303

Inserting the center core of the roll of tape 200 making contact to the tapered end portions (Ta, Tb) of each vertical tower (103A, 103B); and 304

Pushing the roll of tape 200 onto vertical tower (103A, 103B) until it rests firmly against the fixed base 101 of the tape holder 100 305

FIG. 12

ERGONOMIC TAPE HOLDER AND METHOD OF USE THEREOF

RELATED APPLICATIONS

This application claims the benefit of priority of U.S. Provisional Application Ser. No. 63/181,916 filed Apr. 29, 2021, which is hereby incorporated by reference in its entirety.

FIELD OF THE DISCLOSURE

The present disclosure relates to an ergonomic tape holder onto which a roll of tape is mounted and secured. In particular, the ergonomic tape holder is a one-piece constructed apparatus having vertical towers disposed on a fixed based which prevents the roll of tape from shifting, rolling, or moving about the base.

BACKGROUND

Tape dispense assemblies are offered in a variety of designs and application for users of many commercial and non-commercial industries. In the painting industry, for example, a painter will take a roll of tape, apply the tape and then put it down in a random location. A person using a roll of tape may look for creative ways as to where to place the tape with the intention of temporarily storing the roll of tape and having the roll of tape available for continued use. This may include, for example, holding the roll of tape between their legs, pressing the roll of tape using their arm to hold against the side of their body, holding the tape with their mouths or slipping their hand through the center core of the tape roll. As commonly experienced by many painters who use ladders when applying tape, once taping done, the painter will often place the roll of tape on the step of the ladder, which is prone to fall off from the ladder. This is often leads to a cumbersome chore for the painter of having to climb down from the ladder, pick up the tape and again climb up the ladder to continue taping.

There are several products available on the market which provides a convenient way to dispense tape. One such product includes a product known as the "Tape Tool." The Tape Tool is a tape dispenser that is attached to the user's waist line. The problem with this device is that the user can only dispense a certain length of tape, making it inconvenient and cumbersome for jobs that require long length of distance of tape for masking purposes. For example, if a painter has to mask off a base board that is 12 feet long, the Tape Tool will only allow for portions of tape that is about 2-3 feet in length to be applied versus a continuous run of tape that can be applied for much faster application. The Tape Tool is available online at https://www.thetapetool-company.com. With this product the user will actually pull the tape from the dispenser, tear it off and then apply the tape. The problem here is that the user has to remember to fold the end of the tape to mark the place where the edge of the tape is located. So when the user returns to obtain more tape, the user generally does not have to look for the tape edge. This can be problematic if the user forgets to fold the leading edge of the tape and then has to remove the tape from the dispenser to look for the leading edge and the re-install the roll of tape onto the Tape Tool. In addition, the tape dispenser has limited use in the length of tape that can be applied and often is not adequate for applying a long length of tape, such as a 10 foot run. With the Tape Tool, the user has to apply the tape in sections versus one continued piece of tape.

Additionally, for waist line attached tape dispensers such as the Tape Tool, the movement or dispensing tape from the waist line area is not a typical motion to which a user such as a painter will be accustomed. This un-natural tape dispensing motion, where tape is dispensed in 2-3 feet portions, while holding the tape to where it is going to be applied, makes the task difficult dispensing the tape while holding it at the same time difficult without getting the tape intertwined or tangled, often can be a cause of both waste in time and materials.

Other tape holders are also available on the market, most of which are also placed on the waistline and will hold the tape at waist level. Either these tape holders are just holders or a type of tape dispenser. The products that are just tape holders are either made for other types of tape, such as, for example, gaff tape that is used in the movie industry. The product is called the "Tough Gaff Tape Holder" and is available online at https://paintlifesupply.com/products/tough-gaf-tape-holder. The user has to purchase either a 1 in or a 2 in tape holder. Since there are varying tape widths from 0.75 in to 2 in, the Tough Gaff Holder often requires multiple purchases for two different size holders.

Another tape holder that is put on the user's waist line is called "The Tape Thing Caddy" which is available online at https://www.amazon.com/Tape-Thing-Magnetic-Painters-Collision/dp/B07QW3RSB1. With The Tape Thing Caddy, the user has to purchase different sized Tape Thing Caddy for the different tape widths. The uniqueness of this tape holder is that it has a magnet on the back side so that the user can place the Tape Thing Caddy and tape assembly on a vertical metal surface. The Tape Thing Caddy has a waist line metal plate that is separate from the tape holder. The user can freely use the tape and then attach the tape holder assembly to the metal component that is attached to the user's waist. The magnetic part of the Tape Thing Caddy is a plastic insert that goes into the center core of the tape. For varying tape widths, a separate magnetic plastic insert has to be purchased. The second component of the Tape Thing Caddy is the waist line holder to which the tape can magnetically attached.

Thus, there is a continuing need for better, ergonomic, and natural way to secure a roll of tape to an appendage of user while dispensing tape in excess of 5-10 feet portions.

SUMMARY

It is an advantage of the present disclosure to provide an ergonomic tape holder having a fixed base with a plurality of slots, and a two vertical towers disposed on a platform, where the platform is coupled to the fixed base and the two vertical towers project upward from the platform, and where the two vertical towers are configured to receive one or more rolls of tape, and where the two vertical towers are separated by a fixed width.

In one aspect, a strap is disposed in the plurality of slots. In another aspect, a buckle fastener, hook-and-loop fastener, or snap-on fastener is applied to each end of the strap. In yet another aspect, the strap is secured to a wrist or a forearm of a user. In still yet another implementation, the each vertical tower has tapered end portions disposed on a distal end of each vertical tower.

These and other objects, features and advantages of the present disclosure will become more apparent in light of the following detailed description of preferred embodiments thereof, as illustrated in the accompanying drawings.

BRIEF DESCRIPTION OF THE DRAWINGS

The present disclosure will be more clearly understood from the following detailed description of the embodiments of the disclosure and from the attached drawings, in which:

FIG. 4A-FIG. 4D illustrate various types of strap configurations that may be applied to the ergonomic tape holder, including an adjustable band with hook-and-loop fasteners (FIG. 4A), a magnetic locking band (FIG. 4B), a snap-fastener strap (FIG. 4C), and a buckle strap (FIG. 4D), in accordance to an embodiment.

FIG. 12 illustrates a process flowchart demonstrating an application and use of the ergonomic tape holder by the user, in accordance to an embodiment.

In the appended figures, one or more elements may have the same reference numeral in different figures indicating previously described elements.

DETAILED DESCRIPTION

The present disclosure is directed to hold masking tape of varying tape widths. The user can easily apply tape on a desired area such as a section of a wall or window, and then return and place the roll of tape onto the tape holder. The tape holder is configured to secure and hold the roll of tape, preventing it from detaching from the holder during normal use (i.e., painting, taping, masking, etc.), while still allowing the user to easily remove the roll of tape from the tape holder.

Figure 1:
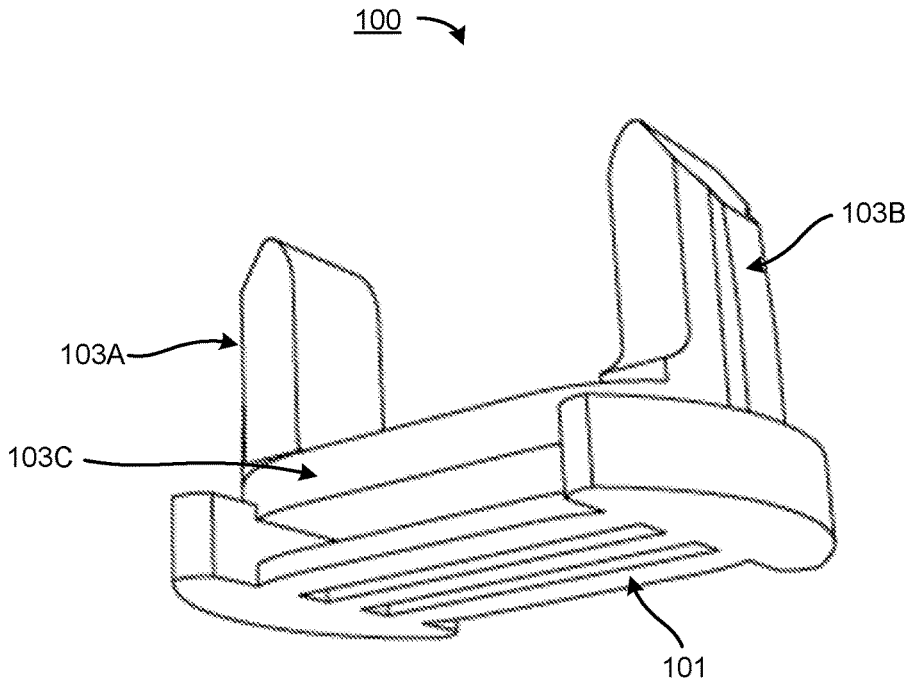
FIG. 1 illustrates an ergonomic tape holder 100, in accordance to an embodiment.

FIG. 1 illustrates an ergonomic tape holder 100, in accordance to an embodiment. The ergonomic tape holder 100 is a single-piece and unitary assembly having no moving parts. In addition, the ergonomic tape holder 100 may include a fixed base 101 and two vertical towers (103A, 103B) disposed on a platform 103C that is coupled to the fixed base 101. Fabrication of the ergonomic tape holder 100 can be accomplished by various manufacturing and process techniques such as injection molding, 3D-printing, laser-cutting, or other similar technologies for fabricating unitary devices. In addition, materials used to form the ergonomic tape holder 100 may include, but is not limited to polylactic acid (PLA), Acrylonitrile butadiene styrene (ABS), polyester, vinyl ester, epoxy, and polyurethane. In practice, the ergonomic tape holder 100 is generally made to be light-weight yet durable and strong, capable of withholding compressive and lateral stress applied to each tower (103A, 103B) when a roll of tape is attached thereon.

Figure 2B:
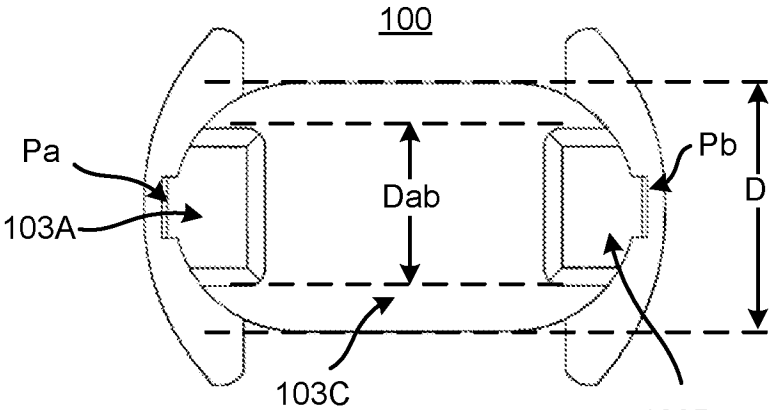
FIG. 2A-FIG. 2D illustrate multiple views of the ergonomic tape holder, including a side view (FIG. 2A), a top view (FIG. 2B), a front view (FIG. 2C), and a bottom view (FIG. 2D), in accordance to an embodiment.
Figure 2D:
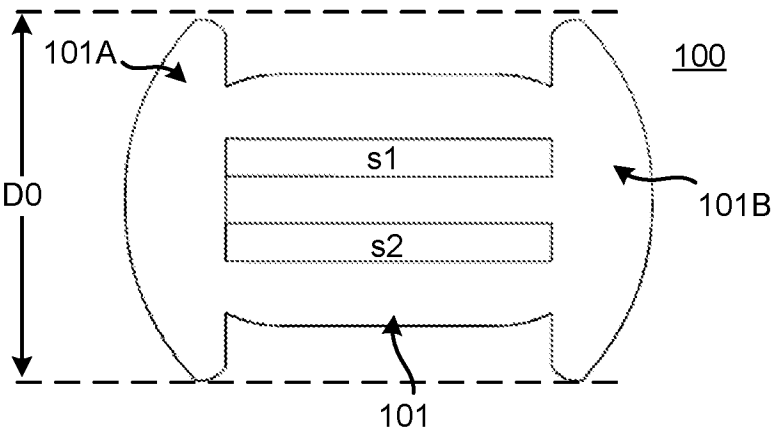
Figure 2A:
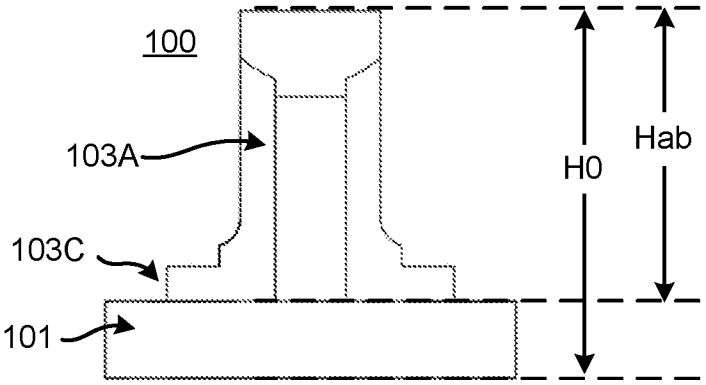
Figure 2C:
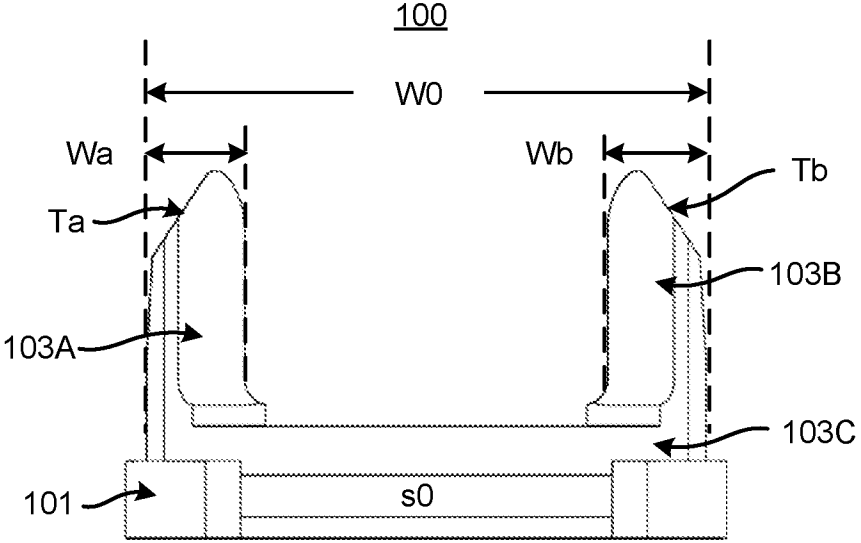
Figure 3B:
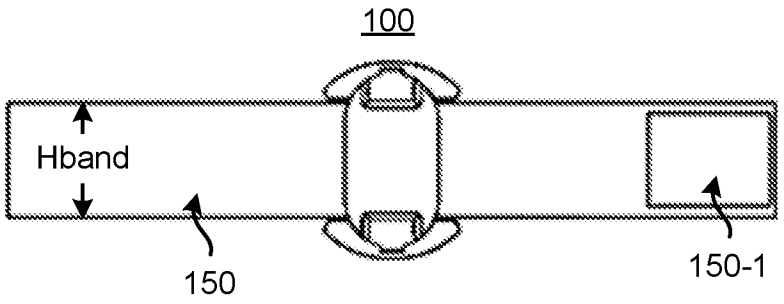
FIG. 3A-FIG. 3D illustrate multiple views of the ergonomic tape holder with a wrist strap attached thereon, including a side view (FIG. 3A), a top view (FIG. 3B), a front view (FIG. 3C), and a perspective view (FIG. 3D), in accordance to an embodiment.
Figure 3D:
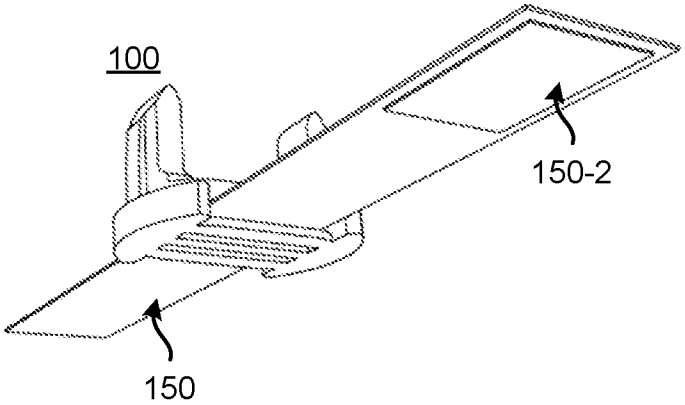
Figure 3A:
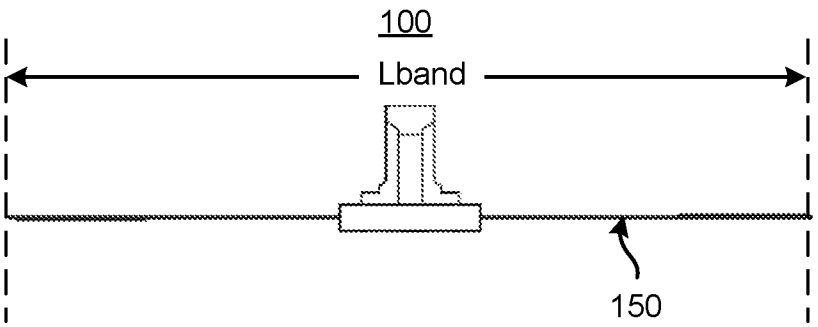
Figure 3C:
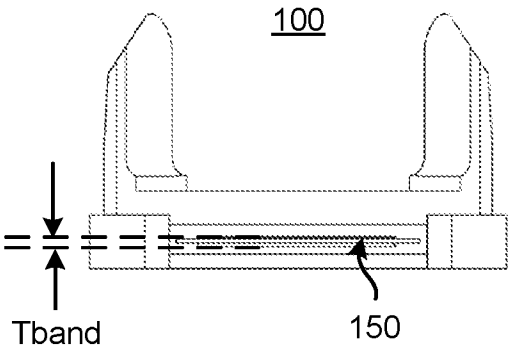

FIG. 2A-FIG. 2D illustrate multiple views of the ergonomic tape holder 100, including a side view (FIG. 2A), a top view (FIG. 2B), a front view (FIG. 2C), and a bottom view (FIG. 2D), in accordance to an embodiment. With respect size, the ergonomic tape holder 100 is approximately 53 mm in total height (H0), 77 mm in total width (W0), and 61 mm in total depth (D0). The size of ergonomic tape holder 100 is not limited to this range and may be configured to have other widths, heights, and depths which are suitable for users of all sizes. In practice, these dimensions are appropriately sized to accommodate and ergonomically fit onto the wrist portion of the user. In one implementation, each vertical tower (103A, 103B) may have a tapered end portion (Ta, Tb) disposed at a distal end of each tower for receiving a roll of tape, acting as a guide for the user to easily slide the roll of tape onto the ergonomic tape holder 100. With respect its size, each vertical tower (103A, 103B) is approximately 48 mm in total height (Hab), 14 mm in total width (Wa, Wb), and 20 mm in total depth (Dab). The size of tower is not limited to this range and may be configured to have other widths, heights, and depths which are suitable for rolls of tape of all sizes. Dimensions of each vertical tower (103A, 103B) are configured to support repeated insertion and removal of rolls of tape onto the ergonomic tape holder 100, providing the necessary strength and durability for daily use. In another implementation, multiple slots may be disposed along portions of the ergonomic tape holder 100 for supporting and receiving a wrist strap (not shown). For example, a strap slot (s0) may be disposed between the platform 103C and a portion of the fixed base 101 while two support strap slots (s1, s2) may be laterally disposed along a top portion of the fixed base 101 as shown in FIG. 2D. In operation, the fixed base 101 is configured to stabilize the roll of tape, preventing it from moving, rocking, or shifting back-and-forth. In one aspect, tapered edges (Ta, Tb) of each vertical tower (103A, 103B) act as entry points where the roll of tape may be inserted, providing a self-guiding mechanism to assist the user in inserting a roll of tape onto the tape holder. In another aspect, the each vertical tower (103A, 103B) of the ergonomic tape holder 100 has two points of contact (Pa, Pb) that are 180 degrees apart, where these points of contact is what holds the roll of tape.

FIG. 3A-FIG. 3D illustrate multiple views of the ergonomic tape holder 100 with a wrist strap 150 attached thereon, including a side view (FIG. 3A), a top view (FIG.

3B), a front view (FIG. 3C), and a perspective view (FIG. 3D), in accordance to an embodiment. In one implementation, the wrist strap 150 may be composed of a flexible yet comfortable fabric band material such as a nylon, natural fibers, synthetic fibers, silicon, leather, or rubber. With respect size, typical dimensions for the strap 150 is approximately 50 mm in total height (Hband), 457 mm in total length (Lband), and 3 mm in total thickness (Tband). The size of strap 150 is not limited to this range and may be configured to have other widths, heights, and depths which are suitable fit the wrist or arm of all sizes. In practice, the wrist strap 150 may be applied and fastened to the wrist of the user via hook-and-loop fasteners (150-1, 150-2) disposed on a bottom and top portion of the strap 150. Other types of strap configurations are presented in the following section.

FIG. 4A-FIG. 4D illustrate various types of strap configurations that may be applied to the ergonomic tape holder 100, including an adjustable band with hook-and-loop fasteners (FIG. 4A), a magnetic locking band (FIG. 4B), a snap-fastener strap (FIG. 4C), and a buckle strap (FIG. 4D), in accordance to an embodiment. In practice, the ergonomic tape holder 100 can be used with almost any type of band, allowing the user to physically attach the ergonomic tape holder 100 to their body such as their forearm, wrist, leg, or other body appendage, via the various types of locking mechanisms shown in FIG. 4A-4D, and thereby providing a convenient access to the roll of tape. The user can put the band on along with the tape holder and then the user will be able to use the tape and return to the tape onto the tape holder. In another implementation, the ergonomic tape holder 100 can be made to fasten onto a waist belt of the user. For example, when the ergonomic tape holder 100 is attached to user's waist line by a belt, the tape holder 100 along with a roll of tape will be on the user's waist line area, allowing for the user to easily use the tape as needed and then return the roll of tape back onto the tape holder 100 located on the waist line area.

Figure 5:
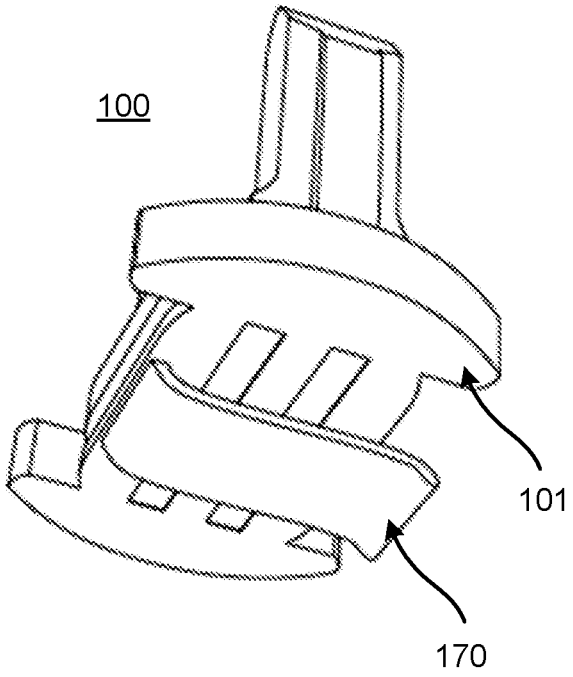
FIG. 5 illustrates the ergonomic tape holder 100 with a clip fastener attached thereon, in accordance to an embodiment.

FIG. 5 illustrates the ergonomic tape holder 100 with a clip fastener 170 attached thereon, in accordance to an embodiment. In yet another implementation, the ergonomic tape holder 100 may include the clip 170 attached to a bottom portion of the fixed base 101 that allows the user to place the tape holder on their waist line area, allowing the user to clip on the tape holder 100 to their belt or waist line via the metal clip 170. The clip fastener 170 may include but is not limited to a metal clip similar to that of a clip of a tape measuring device. It other implementations, the ergonomic tape holder 100 may be secured to the user by other types fasteners such as but not limited to hooks, magnetic fasteners, and adhesives.

Figure 6A:
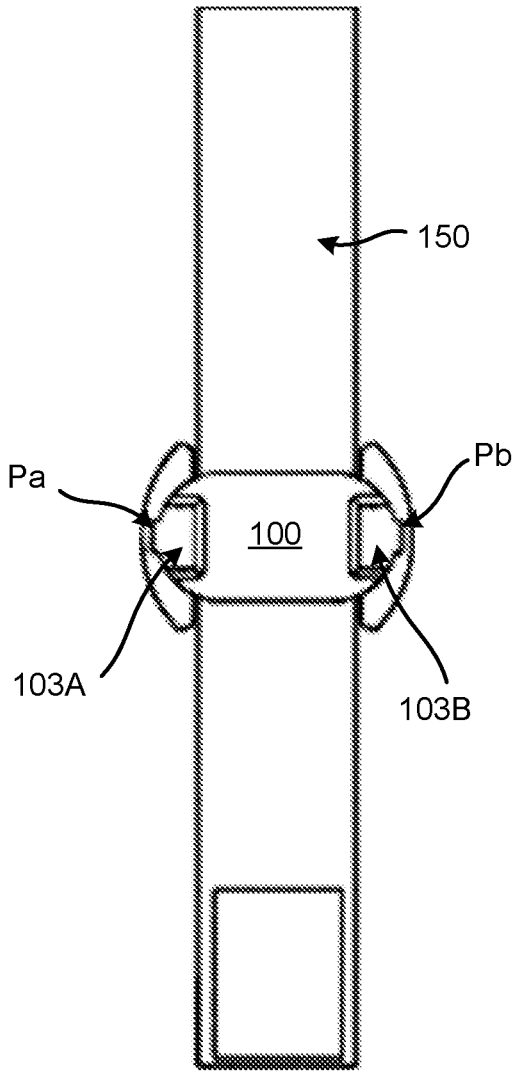
FIG. 6A-FIG. 6B illustrate top views of the ergonomic tape holder before a roll of tape attached (FIG. 6A) to the tape holder and after the roll of tape is attached (FIG. 6B) to the tape holder, in accordance to an embodiment.
Figure 6B:
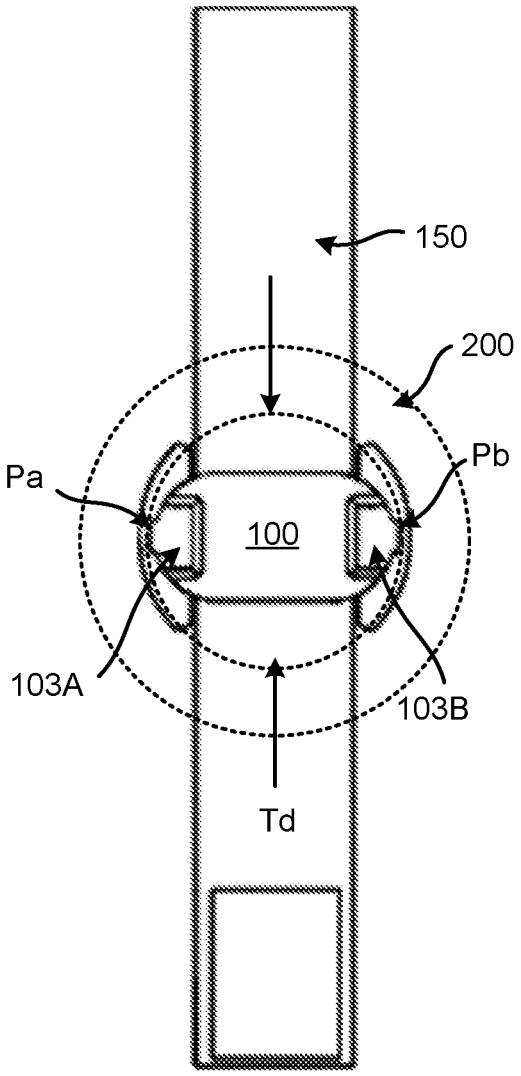

FIG. 6A-FIG. 6B illustrate top views of the ergonomic tape holder 100 before a roll of tape attached (FIG. 6A) to the tape holder 100 and after the roll of tape is attached (FIG. 6B) to the tape holder 100, in accordance to an embodiment. For example, the ergonomic tape holder 100 may configured to secure and hold a roll of tape 200 having a 76 mm (or 3 inch) core diameter (Td) between each vertical tower (103A, 103B) at the two points of contact (Pa, Pb).

Figure 7A:
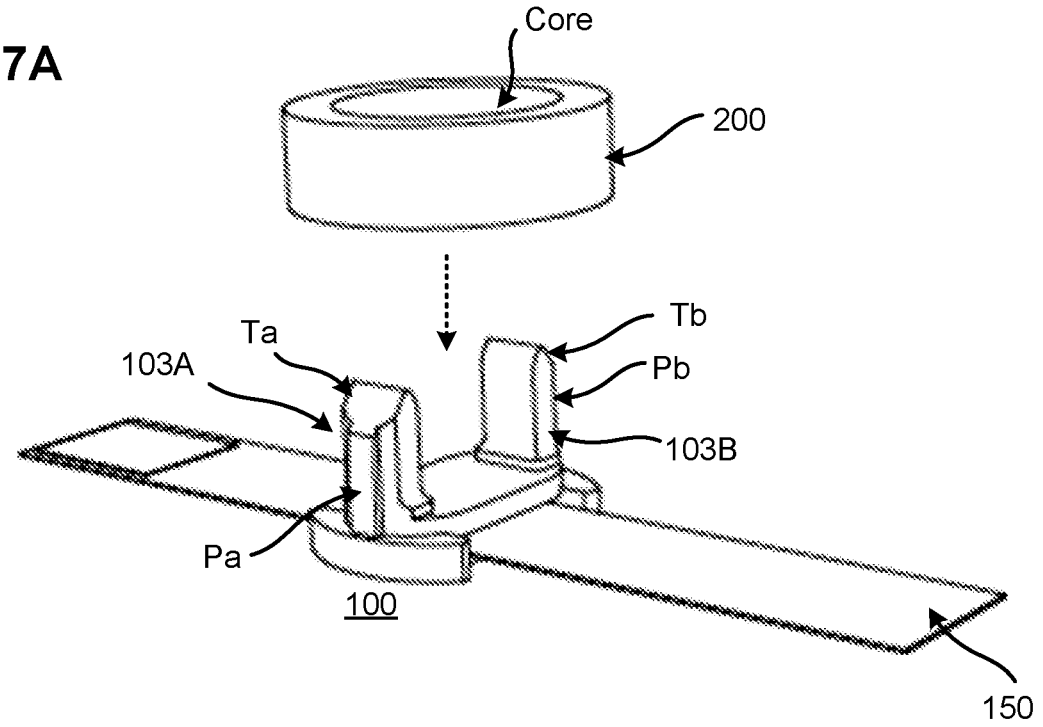
FIG. 7A-FIG. 7B illustrate side perspective views the ergonomic tape holder before a roll of tape attached (FIG. 7A) to the tape holder and after the roll of tape is attached (FIG. 7B) to the tape holder, in accordance to an embodiment.
Figure 7B:
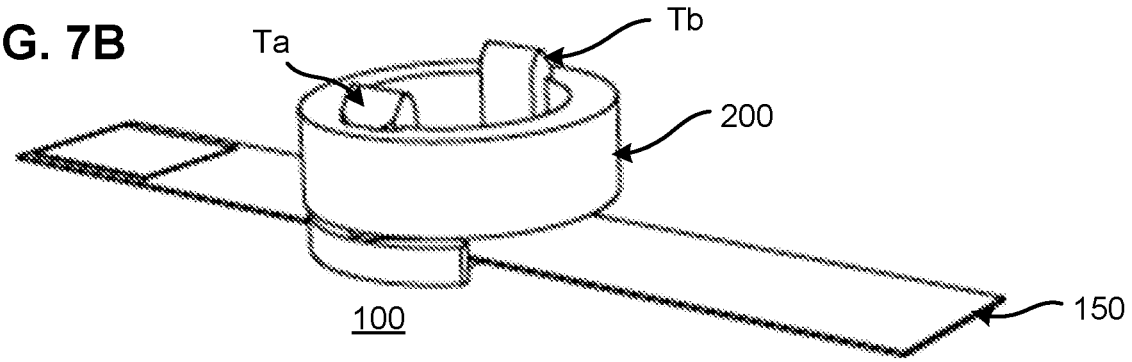

FIG. 7A-FIG. 7B illustrate side perspective views the ergonomic tape holder 100 before a roll of tape attached (FIG. 7A) to the tape holder 100 and after the roll of tape is attached (FIG. 7B) to the tape holder 100, in accordance to an embodiment. Prior to inserting the roll of tape 200 to the ergonomic tape holder 100, the core of tape 200 is aligned directly above and centered between the two vertical towers (103A, 103B) as shown in FIG. 7A. The tapered end portions (Ta, Tb) disposed at the distal end of each vertical tower (103A, 103B) provides a guide which allows towers (103A, 103B) to slide into the center core of the tape 200 during tape insertion. Dimensions and configurations of these tapered end portions and separation of vertical towers (103A, 103B) are precisely sized and configured so that the roll of tape 200 is firmly secured to the tape holder 100 at two points of contact (Pa, Pb), preventing it from falling off from the holder during normal use (e.g., painting, masking, etc.), while still allowing the user to easily remove the roll of tape 200 from the tape holder 100.

Figure 8A:
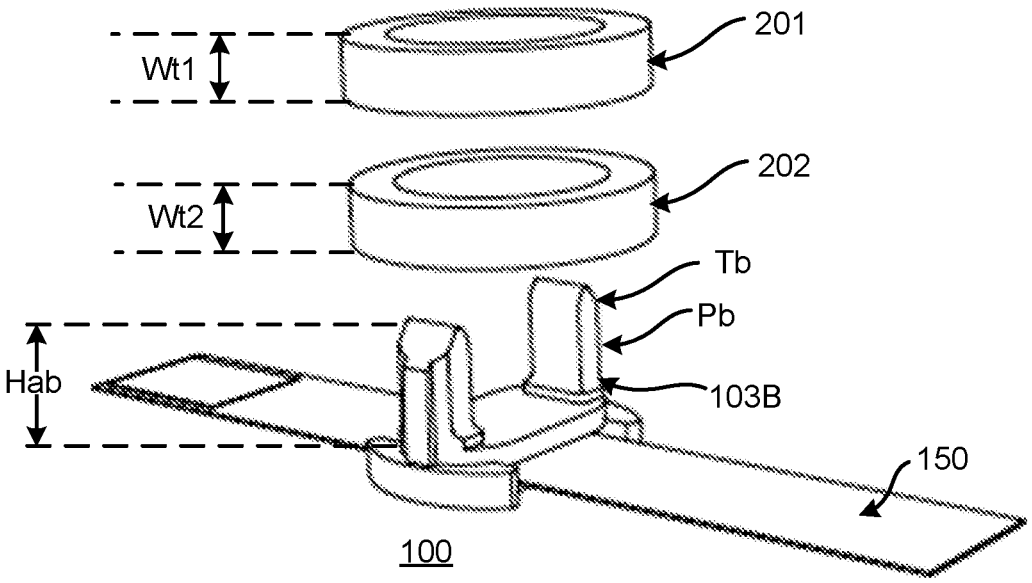
FIG. 8A-FIG. 8B illustrate side perspective views the ergonomic tape holder with two rolls of tape applied to the tape holder, in accordance to an embodiment.
Figure 8B:
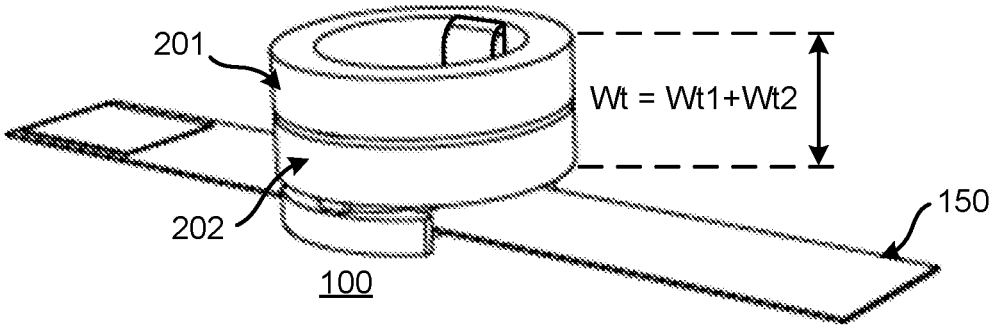

FIG. 8A-FIG. 8B illustrate side perspective views the ergonomic tape holder 100 with two rolls of tape (201, 202) applied to the tape holder 100, in accordance to an embodiment. In one implementation, the ergonomic tape holder 100 can support multiple rolls of tape having a total combined width (Tw) not exceeding the total height (Hab) of each vertical tower (103A, 103B). For example, the ergonomic tape holder 100 may hold two rolls of tape (201, 202) where the first roll of tape 201 has a first width of Wt1 and the second roll of tape has a second width of Wt2, having a total combined width (Wt) which is less than the total height (Hab) of each vertical tower (103A, 103B).

Figure 9A:
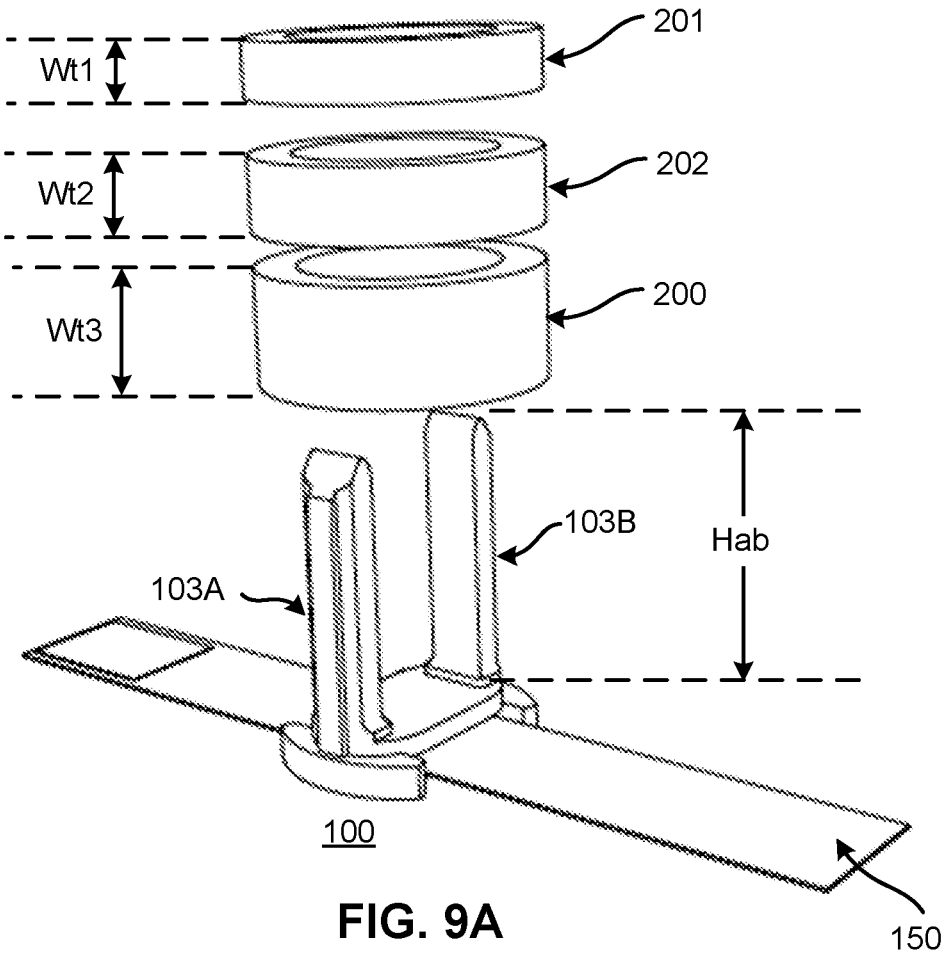
FIG. 9A-FIG. 9B illustrate side perspective views the ergonomic tape holder with elongated vertical tower for securing multiple rolls of tape, in accordance to an embodiment.
Figure 9B:
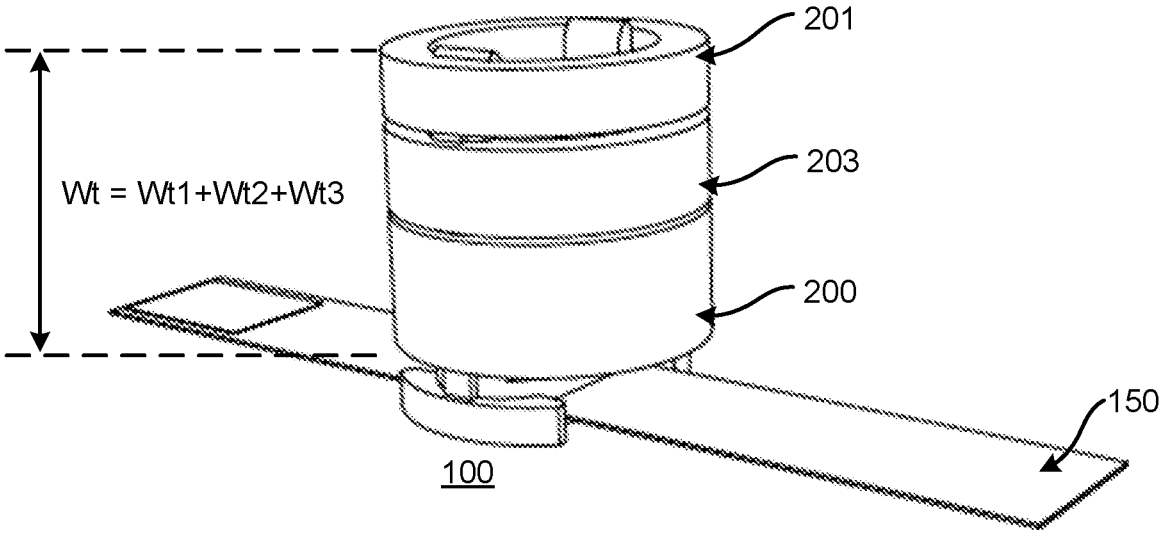

FIG. 9A-FIG. 9B illustrate side perspective views the ergonomic tape holder 100 with elongated vertical tower (103A, 103B) for securing multiple rolls of tape, in accordance to an embodiment. The rolls of tape (200, 201, 203) may come in a variety of tape widths measuring between 3 mm to over 100 mm. To accommodate multiple rolls of tape, the ergonomic tape holder 100 may have elongated vertical tower (103A, 103B) which are configured to support both the total height Wt of the combined rolls of tape (200, 201, 203) as well as its combined weight as shown in FIG. 9B.

Figure 10A:
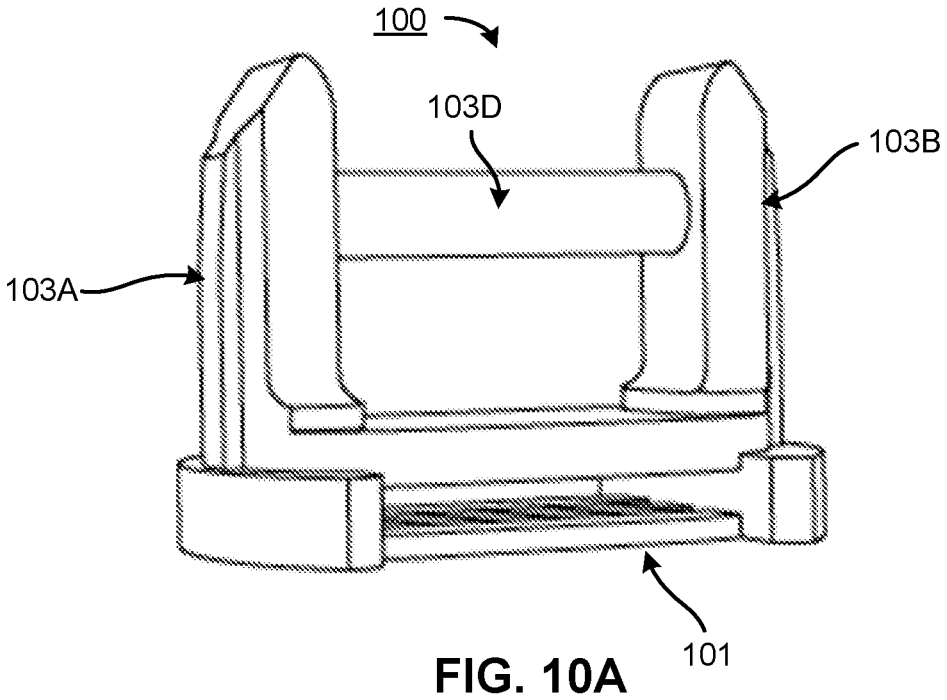
FIG. 10A-FIG. 10B illustrate perspective views the ergonomic tape holder with a support member between the two vertical towers, in accordance to an embodiment.
Figure 10B:
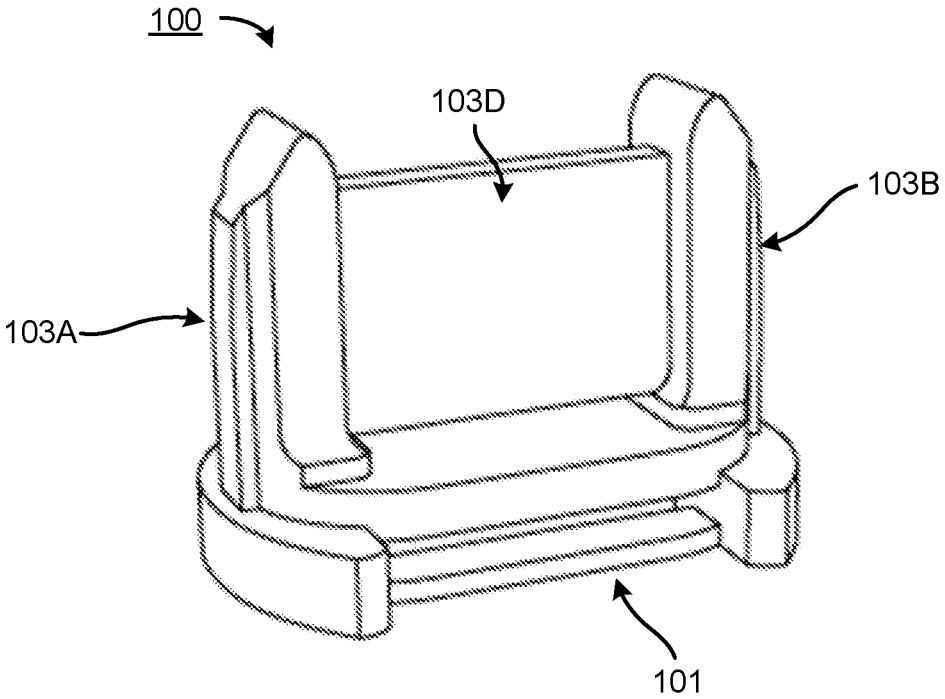

FIG. 10A-FIG. 10B illustrate perspective views the ergonomic tape holder 100 with a support member 103D disposed between the two vertical towers (103A, 103B), in accordance to an embodiment. In one embodiment, the support member 103D may include but is not limited to a cross-bar disposed between a top portion of the two vertical towers (103A, 103B) as shown in FIG. 10A. In another embodiment, the support member 103D may include but is not limited to a plate member disposed between a top portion of the two vertical towers (103A, 103B), spanning the entire height of the two vertical towers (103A, 103B) as shown in FIG. 10B. In application, the support member 103D is configured to provide lateral support of the two vertical towers (103A, 103B), preventing the towers to bend inward along the top portion of each tower when the roll of tape is inserted onto the towers.

Figure 11A:
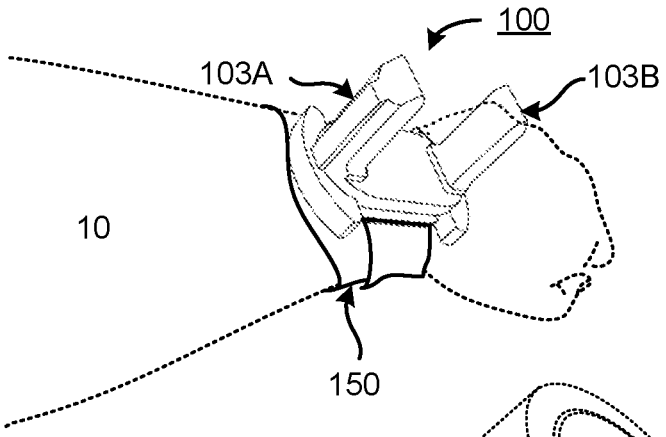
FIG. 11A-FIG. 11C illustrate a visual demonstration and application of the ergonomic tape holder by a user, in accordance to an embodiment.
Figure 11B:
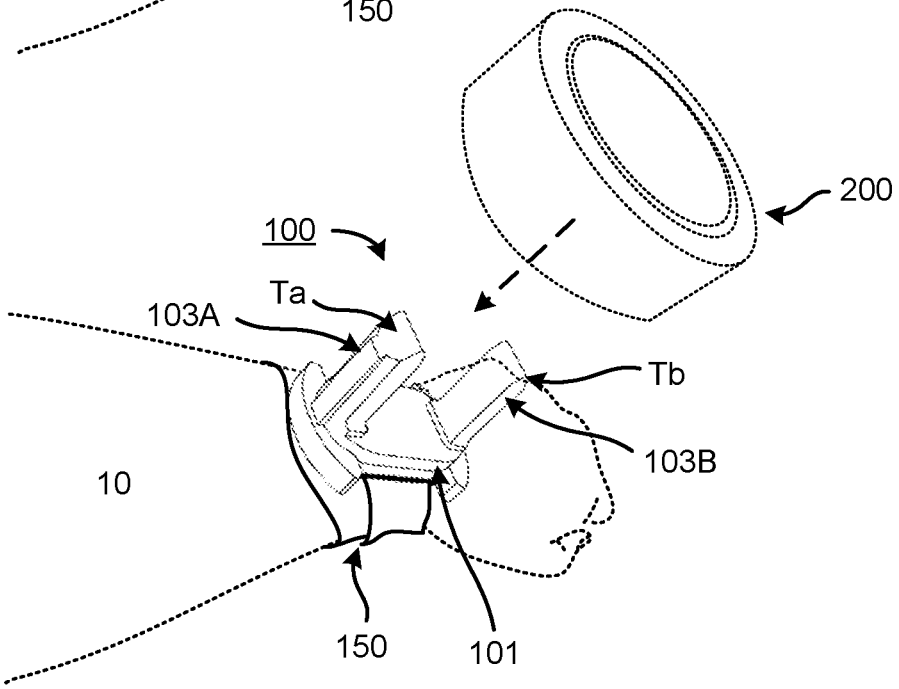
Figure 11C:
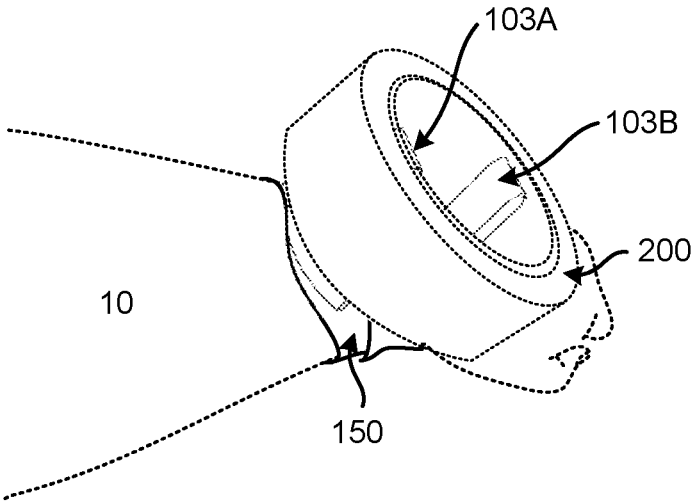

FIG. 11A-FIG. 11C illustrate a visual demonstration and application of the ergonomic tape holder 100 by a user 10, in accordance to an embodiment. First, the user 10 may position the tape holder 100 over their wrist or forearm so that the two vertical towers (103A, 103B) project above a top portion of their hand, securing the strap 150 of the ergonomic tape holder 100 to their wrist or forearm via the hook-and-loop fasteners as shown in FIG. 11A. Next, while holding the roll of tape 200 with their other hand, the user 10 positions the center core of the roll of tape 200 so that is centered between the vertical towers (103A, 103B) as shown in FIG. 11B. Finally, the user 10 inserts the center core of the roll of tape 200 making contact to the tapered end portions (Ta, Tb) of each vertical tower (103A, 103B), and then pushing the roll of tape 200 onto the vertical towers (103A, 103B) until it rests and secured against the fixed base 101 of the tape holder 100 as shown in FIG. 11C.

FIG. 12 illustrates a process flowchart 300 demonstrating an application and use of the ergonomic tape holder 100 by the user 10, in accordance to an embodiment. For example, a method for attaching and using the holder 100 include:

1) Step 301—Positioning the ergonomic tape holder 100 over a wrist, forearm, or leg of a user so that the two vertical towers (103A, 103B) project above a top portion of a hand of the user;
2) Step 302—Securing the strap 150 of the ergonomic tape holder 100 to their wrist or forearm via hook-and-loop fasteners;
3) Step 303—While holding the roll of tape 200 with their other hand, positioning the center core of the roll of tape 200 so that is centered between the vertical towers (103A, 103B);
4) Step 304—Inserting the center core of the roll of tape 200 making contact to the tapered end portions (Ta, Tb) of each vertical tower (103A, 103B); and
5) Step 305—Pushing the roll of tape 200 onto the vertical towers (103A, 103B) until it rests firmly against the fixed base 101 of the tape holder 100.

A method for removing the holder 100 is generally performed in reverse order in two simple steps, including:

1) Step 306—Pulling the roll of tape 200 in an upward direction from the vertical towers (103A, 103B) of the tape holder 100 by the other hand of the user; and
2) Step 307—Removing the strap 150 of the ergonomic tape holder 100 from the wrist, forearm, or leg via the hook-and-loop fasteners.

Figure 13:
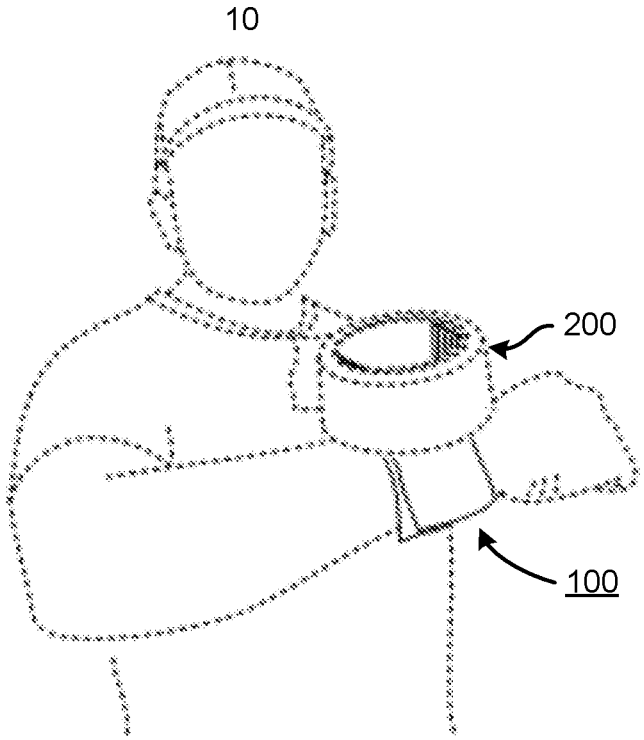
FIG. 13 illustrates a typical end use and context of size and proportions of the ergonomic tape holder and the user 10, in accordance to an embodiment.

FIG. 13 illustrates a typical end use and context of size and proportions of the ergonomic tape holder 100 and the user 10, in accordance to an embodiment. Several advantages of the ergonomic tape holder 100 include but are not limited to: 1) the configuration, design and separated distance of the two points of contact (Pa, Pb) that hold the roll of tape 200 in place which prevent the tape from falling of the holder 100 while still allowing the user 10 to insert and remove the roll of tape from the vertical towers (103A, 103B); 2) the vertical parts that have tapered edges (Ta, Tb) at the tip of the vertical towers (103A, 103B) helps guide the roll of tape 200 onto the two towers. Without this the tapered tops, the user would likely find it difficult to place the roll of tape onto the tape holder 100; 3) the strap 105 that secures the ergonomic tape holder 100 to wrist or forearm of the user, allowing the tape holder 100 to rest at the arm or hand level in a natural way that secures the roll of tape to the user, providing a convenient solution that helps improve production efficiency for users such as painters, dry wall installers, and so on; 4) the overall compact, single-piece, and light weight design which is made to minimize the amount of material to fabricate the ergonomic tape holder 100; 5) the configuration and design of the vertical towers (103A, 103B) and fixed base 100 which are suitable many rolls of tape having varying widths; and 6) providing the user free mobility and use of the roll of tape, allowing them to apply the tape in a continuous run or apply tape in small sections while still being attached to their wrist or forearm.

In practice, the user can still use a roll of tape as they are accustomed to when painting and tape masking, but will also have a fixed location to store the roll of tape once they are done taping. Furthermore, the ergonomic tape holder 100 provides a quick, handy, and convenient solution of storing and accessing their tape rolls, without having to search for the roll of tape. Moreover, the ergonomic tape holder 100 provides economic advantages since the user only needs to buy one product that is suitable for a variety of tape widths.

All patents, patent applications, and other references cited herein are incorporated by reference in their entireties.

The singular forms "a", "an", and "the" included plural referents unless the context clearly dictates otherwise, as applied in the specification and the appended claims.

It is noted that the disclosure provide herein has been provided merely for the purpose of explanation and is in no way to be construed as limiting of the present disclosure. Although the present disclosure has been shown and described with respect to several preferred embodiments thereof, various changes, omissions, and additions to the form and detail thereof, may be made therein, without departing from the spirit and scope of the disclosure. It is understood that the words which have been used herein are words of description and illustration, rather than words of limitation. Changes may be made, within the purview of the appended claims, as presently stated and as amended, without departing from the scope and spirit of the present disclosure in its aspects.

Other implementations and modifications of the present disclosure may occur to those of ordinary skill of the art in view of these teachings in the specification and drawings. Accordingly, the disclosure is to be limited only by the following claims which include all other such embodiments and modifications when viewed in conjunction with the above specifications and accompanying figures.

What is claimed is:

1. An ergonomic tape holder comprising: a fixed base having a plurality of slots; and two vertical towers disposed on a platform, wherein the platform is coupled to the fixed base and the two vertical towers project upward from the platform, wherein the two vertical towers are configured to receive one or more rolls of tape, wherein the two vertical towers are separated by a fixed width, wherein a strap having two end portions is disposed in the plurality of slots.

2. The ergonomic tape holder of claim 1, wherein a buckle fastener, a hook-and-loop fastener, or a snap-on fastener is applied to each end portion of the strap.

3. The ergonomic tape holder of claim 1, wherein the strap is secured to a wrist, a forearm, or a leg of a user.

4. The ergonomic tape holder of claim 1, wherein each vertical tower has tapered end portions disposed along a distal end of each vertical tower.

5. The ergonomic tape holder of claim 4, wherein the roll of tape is firmly secured to the ergonomic tape holder at two points of contact disposed on each vertical tower.

6. The ergonomic tape holder of claim 1, wherein the fixed base, two vertical towers, and platform are part of a unitary and single-piece assembly with no moving parts.

7. The ergonomic tape holder of claim 1, wherein a metal clip is attached to a backside portion of the platform.

8. The ergonomic tape holder of claim 1, wherein one or more rolls of tape includes masking tape, painter's tape, or duct tape.

9. The ergonomic tape holder of claim 1, wherein a support member is disposed between the two vertical towers, providing lateral support along a top portion of each tower.

10. A method of applying tape using an ergonomic tape holder comprising: a fixed base having a plurality of slots; and two vertical towers disposed on a platform, wherein the platform is coupled to the fixed base and the two vertical towers project upward from the platform, wherein the two vertical towers are configured to receive one or more rolls of tape, wherein the two vertical towers are separated by a fixed width, the method comprising:

positioning the ergonomic tape holder over a wrist or forearm of a user so that the two vertical towers project above a top portion of a hand of the user;

securing a strap of the ergonomic tape holder to the wrist or forearm of the user via a fastener;

while holding the roll of tape with another hand of the user, positioning a center core of the roll of tape so that is centered between the vertical towers;

inserting the center core of the roll of tape making contact to the tapered end portions of each vertical tower; and pushing the roll of tape onto the vertical towers until it rests firmly against the fixed base of the tape holder.

11. The method of claim 10, a strap having two end portions is disposed in the plurality of slots.

12. The method of claim 10, wherein the fastener is applied to each end portion of the strap and is comprised of a buckle fastener, a hook-and-loop fastener, or a snap-on fastener.

13. The method of claim 10, wherein the strap is secured to a wrist, forearm, or a leg of a user.

14. The method of claim 10, wherein each vertical tower has tapered end portions disposed along a distal end of each vertical tower.

15. The method of claim 14, wherein the roll of tape is firmly secured to the ergonomic tape holder at two points of contact disposed on each vertical tower.

16. The method of claim 10, wherein the fixed base, two vertical towers, and platform are part of a unitary and single-piece assembly with no moving parts.

17. The method of claim 10, wherein a metal clip is attached to a backside portion of the platform.

18. The method of claim 10, wherein one or more rolls of tape includes masking tape, painter's tape, or duct tape.

19. The method of claim 10, wherein a support member is disposed between the two vertical towers, providing lateral support along a top portion of each tower.

* * * * *